United States Patent [19]

Lubojatsky et al.

[11] Patent Number: 4,679,856

[45] Date of Patent: Jul. 14, 1987

[54] MINE SELF-ADVANCING ROOF SUPPORT AND METHOD OF RELOCATING A MINE WINNING FACE EQUIPPED WITH SELF-ADVANCING ROOF SUPPORT

[75] Inventors: Walter Lubojatsky, Recklinghausen; Hans Lachner, Herne; Gerald Seebacher, Recklinghausen, all of Fed. Rep. of Germany

[73] Assignee: Klöckner-Becorit GmbH, Castrop-Rauxel, Fed. Rep. of Germany

[21] Appl. No.: 653,872

[22] Filed: Sep. 21, 1984

[30] Foreign Application Priority Data

Sep. 21, 1983 [DE] Fed. Rep. of Germany ..... 3334004
Aug. 4, 1984 [DE] Fed. Rep. of Germany ..... 3428854

[51] Int. Cl.[4] ..... E21D 15/44; E21D 23/00

[52] U.S. Cl. ..... 299/11; 299/33; 405/302

[58] Field of Search ..... 299/33, 11, 32; 405/298, 299, 300, 302

[56] References Cited

U.S. PATENT DOCUMENTS

| | | | |
|---|---|---|---|
| 2,935,310 | 5/1960 | Davies | 299/43 |
| 3,198,087 | 9/1965 | Potts et al. | 299/33 X |
| 3,631,681 | 1/1972 | Taylor et al. | 405/299 |
| 3,855,808 | 12/1974 | Alacchi | 405/299 |
| 4,007,966 | 2/1977 | Wenneborg | 299/11 |
| 4,227,833 | 10/1980 | Plester et al. | 405/299 |
| 4,391,469 | 7/1983 | Arsuaga | 299/11 |
| 4,402,634 | 9/1983 | Merten et al. | 405/299 |
| 4,432,673 | 2/1984 | Buckmaster | 405/298 |

FOREIGN PATENT DOCUMENTS

| | | | |
|---|---|---|---|
| 353213 | 4/1979 | Austria . | |
| 1232909 | 1/1967 | Fed. Rep. of Germany . | |
| 1236451 | 3/1967 | Fed. Rep. of Germany | 405/299 |
| 1608288 | 12/1970 | Fed. Rep. of Germany . | |
| 1758697 | 5/1971 | Fed. Rep. of Germany . | |
| 3238256 | 4/1984 | Fed. Rep. of Germany . | |
| 3334004 | 4/1985 | Fed. Rep. of Germany . | |

OTHER PUBLICATIONS

Trade Journal "Glückauf" 117, 1981, No. 24, pp. 1587–1590.

Trade Journal "Glückauf" 116, 1980, No. 11, pp. 539–545.

Trade Journal "Glückauf" 114, 1978, No. 10, pp. 430–434.

*Primary Examiner*—James A. Leppink
*Assistant Examiner*—Matthew Smith
*Attorney, Agent, or Firm*—Collard, Roe & Galgano

[57] ABSTRACT

A self-advancing roof support for the face roof support in underground mining operations, having a plurality of supporting frames with self-advancing mechanisms acting perpendicular to the breast of the working, which mechanisms advance the supporting frames in the direction of the breast of the working. In order to facilitate the relocation of a winning face equipped with such a self-advancing roof support, these supporting frames have a plurality of self-advancing gears acting parallel to the breast of the working, to successively shift the supporting frames in the lateral direction parallel to the breast of the working, so as to produce a cut or road for the installation of a new winning face at a head side of the face equipment and to advance the self-advancing roof support sideways into the road together with the complete face equipment while maintaining the formation.

15 Claims, 3 Drawing Figures

MINE SELF-ADVANCING ROOF SUPPORT AND METHOD OF RELOCATING A MINE WINNING FACE EQUIPPED WITH SELF-ADVANCING ROOF SUPPORT

The invention relates to a mine self-advancing roof support system for the face roof support in underground mining operations, having a plurality of supporting frames with a self-advancing gear acting perpendicular to the breast of the working, so as to advance the roof support frames in the direction of the breast of the working.

A modern winning face equipped with a self-advancing roof support, a high speed winning machine and a continuously working face conveyor permits relatively high winning speeds even with great lengths of the winning face, and minimizes the intervals to transfer the complete face equipment to another working location. This applies even where only relatively short undisturbed lengths of the mining field are available in the direction of face advancement due to the geological conditions as found, for example, in pit coal mining operations. In addition, geological faults that cannot be cut through with the face equipment often appear also within the length of the mining field scheduled in the winning plan, necessitating the frequent relocation of the winning face.

The relocation of the winning face is extremely costly because of the dismantling, transportation and installation costs associated with each relocation. As an example, in Germany, approximately 500 million dollars is spent annually for such relocations of the winning face in German pit coal mining operations. These high costs adversely affect the profitability of the use of expensive winning face equipment.

As disclosed in DE-OS No 30 31 113, it is known that the relocation costs can be reduced if the self-advancing roof supports of the face equipment are immediately relocated in the gallery driven with a short-breast winning machine instead of with a preliminary support. However, even this method does not reduce the dismantling, transportation and reassembly costs because the self-advancing roof support frames have to be individually dismantled, partially disassembled for transportation to the new installation site and then reassembled again and set up at the new site.

In DE-AS No. 25 38 084, a method is described for long-breast winning in room-and-pillar mining systems, wherein a conveyor combined with a winning machine is advanced in its longitudinal direction into a gallery previously driven for installation of a new winning face. That method, however, can be used only in room-and-pillar systems without self-advancing roof support and with a relatively short conveyor length. A face conveyor with the construction length commonly found in longwall mining systems cannot be readily displaced in the longitudinal direction because no abutment is available that would suffice for its great weight. Moreover, the conventional self-advancing roof support cannot be shifted sideways.

It is therefore an object of the present invention to provide an improved self-advancing roof support system which significantly facilitates the relocation of the winning face equipped with such a roof support system.

It is a further object of the invention to afford a method permitting the relocation of the complate face equipment to a new working site while maintaining the formation.

It is a further object of the invention to provide face equipment capable of automatically migrating to a new starting position, thereby bypassing unforeseen obstacles, geological faults or the like.

These objects are accomplished by a self-advancing roof support system for the face roof support in underground mining operations, having a plurality of supporting frames with a self-advancing gear acting perpendicular to the breast of the working, to advance the supporting frames toward the breast of the working, and with additional self-advancing gears acting parallel to the breast of the working. These additional gears shift the supporting frames successively sideways parallel to the breast of the working.

The self-advancing roof support according to the invention has the advantage that it is capable of advancing sideways in the longitudinal direction of the winning face parallel to the breast of the working, and thus is capable of leaving the winning face by migrating sideways and of advancing sideways into a new cut or road for the installation of a new winning face.

This sideways migration requires that space be provided for the lateral displacement of the supporting frame advancing at any given moment. In order to assure that such space is always available, a special embodiment of the invention provides that the advancing gear acting parallel to the breast of the working be connected with a sequence-controlling device to automatically displace sideways the support frames in successive order.

The improved self-advancing roof support of the invention permits the implementation of a particularly simple method of relocating a winning face equipped with such a self-advancing roof support. In this method, a cut or road for the installation of a new winning face or a connection road within the seam leading to the new working site is driven across the width of the winning face at the head side of the face equipment, into which cut or connection road the support frames advance automatically by migrating sideways while maintaining their formation.

The method according to the invention permits relocating the self-advancing roof support in formation to a new working site without dismantling the roof support into its individual parts. This method substantially reduces relocation costs so that the additional installation costs of the second advancing gear for the equipment are compensated for within a short time.

According to the invention, the face conveyor is automatically advancing in its longitudinal direction, migrating into the cut for the installation of a new winning face or into the connection road. In this way, even the face conveyor need not be dismantled into its components and reassembled in the new cut. Face conveyors capable of automatically advancing in the longitudinal direction and extending through curves, are the object of the older German patent application No. P 32 41 129, corresponding to U.S. patent application Ser. No. 547,945, filed Nov. 2, 1983.

Furthermore, it is advantageous that the road for the installation of a new winning face or the connection road is cut with a short-breast winning machine by a conventional method, wherein self-advancing roof supports and the face conveyor continuously follow a short-breast winning machine. In this way, the new starting position is practically prepared by the face equipment itself, which eliminates the requirement for a separate cut or road.

The conventional longwall mining system is a rigid system with only limited adaptability. It is made much more flexible by the use of the instant invention, which adapts this system to unforeseen geological faults by the unproblematic relocation of the winning face. Consequently, more intensive exploitation of high-speed equipment is achieved.

Moreover, the short-breast winning machine, after the cut or road has been completed, is advantageously used as a stable hole winning machine.

The objects of the invention are accomplished in a preferred embodiment, which uses a face conveyor and support frames which migrate sideways and advance around curves at the end of the ending winning face, at the inlet of the cut, or, in the course of the connection road. Therefore, the complete face equipment advances in a closed formation even around curves, permitting said equipment to assume any desired position within the mining field. As a result, it is particularly possible also to overcome larger distances by bypassing obstacles. This preferred embodiment also uses a conveyor capable of automatically advancing in its longitudinal direction around curves as has been disclosed in the aforementioned older German Application No. P 32 41 129, corresponding to U.S. patent application Ser. No. 547,945, filed Nov. 2, 1983.

It is advantageous to use the self-advancing roof support according to the invention when setting up a new winning face. In mountain formations with readily breakable roof layers, the lateral advancement of the face roof support into a cut for the installaton of a new winning face may pose problems. Due to the alternating tightening or chucking and loosening of the support frames, the roof within the starting zone of the cut is subjected to high alternating loads, with the hazard that the roof may be subject to the so-called stamping effect, causing the hazard of destruction of the roof by breakins. To avoid this hazard, the roof of the cut for the installation for a new winning face in conventional systems must be secured by additioal support measures, for example, by anchor supports.

To resolve this problem, the invention provides that a cut for installing a new winning face is extended beginning at the basic line step by step in each case by the width of a support frame and is widened by the width of a winning road extending in front of the support frame. In addition, the support frames are advanced after each extension and widening of the cut sideways by one length of the step in each case, and by one length of the step in the direction of the breast of the working. Thereafter, the row of support frames is extended or lengthened from the basic road step by step by newly installed support frames until all support frames have been brought into the winning face.

According to the invention, the row of supports migrate into the cut being lengthened step by step, and are advanced after each lateral step in the direction of the working by the width of the winning road. In this way, the row of supports is always located beneath newly exposed, still undestroyed roof. The hazard of the stamping effect which could destroy the roof is avoided in a simple manner, so that no additional support measures are required in the cut for installing a new winning face. With this method, the lateral advancement of the row of supports that is being extended step by step is combined with the first working of the winning face. Consequently, coal may be mined and conveyed in a particularly advantageous way even while the winning operation is still being set up. Of course, when one reaches the end of the mining field, the same method can be employed in the reverse sequence by shortening the row of supports that is advancing in the direction of the winning face. In this way, the roof-damaging stamping effect can be avoided also when the support frames are laterally removed from the winning face as the mining operation is being terminated.

So that conventional winning and conveying equipment can be immediately used at the breast of the working in a new mining operation; the face conveyor automatically advances in a conventional manner in its longitudinal direction, migrating into the cut along the developing breast of the working.

Most desirably, a short-breast winning machine is employed for extending the cut, and the long-breast winning machine of the face equipment is used for the widening of the cut or road for installing a new winning face. The short-breast winning machine, after the face equipment has been installed, is then used as a stable hole winning machine. Therefore, it is thus possible to set up the winning face exclusively with the help of components normally included in the face equipment.

Other objects and features of the present invention will become apparent from the following detailed description when taken in connection with the accompanying drawings which disclose an embodiment of the invention. It is to be understood that the drawings are designed for the purposes of illustration only, and are not intended as a definition of the limits and scope of the invention. In the drawings wherein similar reference numerals denote similar elements throughout the views.

Figure 1:
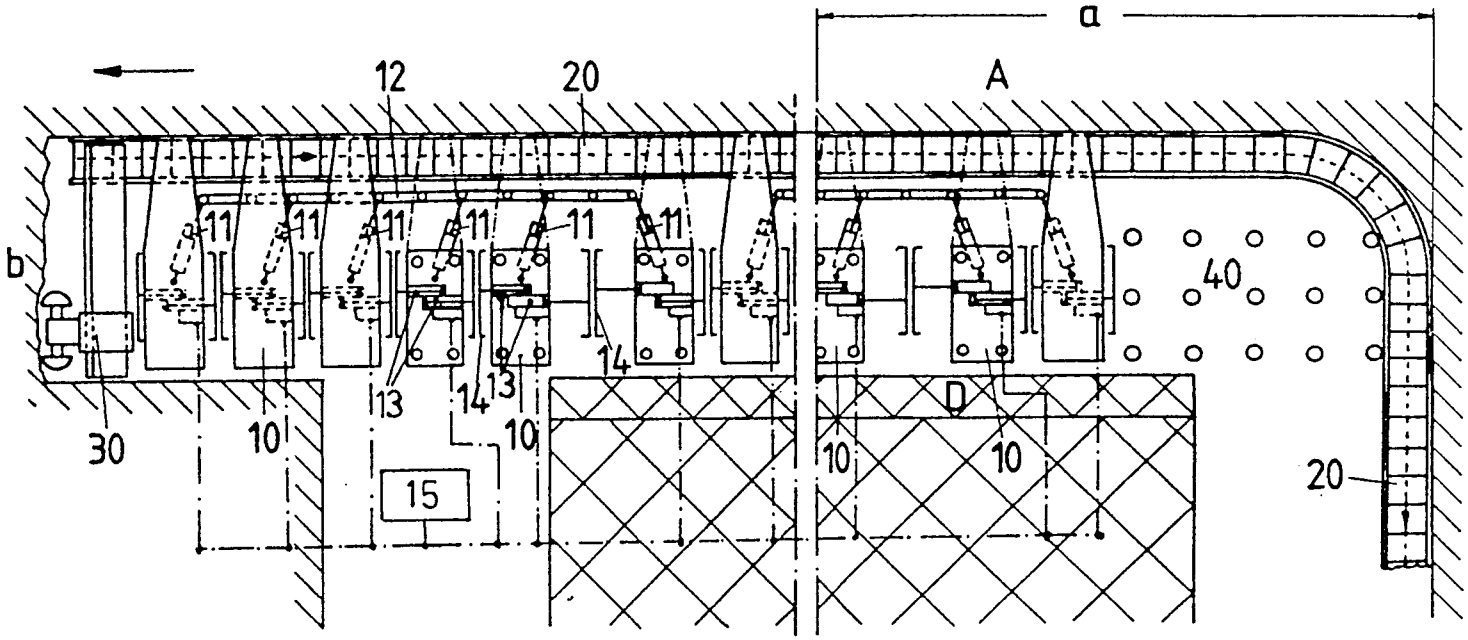
FIG. 1 is a schematic top view of a self-advancing roof support according to the invention migrating in the longitudinal direction of the winning face.

Referring now in detail to the drawings, a plurality of individual face roof support frames 10, is provided with advancing means, such as the hydraulic piston and cylinder 11, acting perpendicular to the breast of the working in the direction of the breast of the working. Each means 11 permits each roof support frame 10 to advance in the direction of the breast of the working. The advancing means 11 corresponding to roof support frames 10 are jointly secured on an anchoring beam 12 arranged in front of the support frames 10. When each individual support frame 10 of the group advances, this anchoring beam 12 is held back or retained by the advancing means 11 of the remaining support frames 10. Anchoring beam 12 serves as the abutment for the advancing action of the support frames 10 advancing at that moment. The advancing means 11 are movably secured on the support frames 10 on the one side and on the anchoring beam 12 on the other side in a way such that the support frames 10 are capable of displacement in the longitudinal direction of the winning face with swivelling of the advancing means 11. Alternatively, the advancing means 11 may be secured on the anchoring beam 12 displaceably and lockably hinged in the longitudinal direction of the winning face in a way such that they are capable of being displaced in the longitudinal direction of the winning face. The anchoring beam 12 may be replaced by a face conveyor consisting of segments capable of being urged against each other. In order to permit a displacement of the face roof support frames 10 in the longitudinal direction of said conveyor, the advancing means 11 may be similarly hinged on the conveyor. The advancing means 11 may be detached from the conveyor or connected to the conveyor in a way such that they are solidly fixed thereon under pulling and pushing conditions, but displaceable with the conveyor in the longitudinal direction of the winning face.

Furthermore, the support frames 10 have the advancing means 13 acting in the longitudinal direction of the winning face. Means 13 can be extended sideways and supported by each of the other advancing means by supporting plates 14 which, if necessary, comprise components of the gap sealing mechanism between each of the support frames 10. By extending and retracting said advancing means 13, it is possible to successively displace the support frames 10 sideways, in each case by the urging of the advancing means 13. Of course, within each group of support frames 10, sufficient space has to be available sideways, to compensate for one full step of displacement sideways, of each support frame 10. Because the space conditions permit a lateral displacement of the group of support frames 10 only in successive order, the advancing means 13 are, therefore, controlled by an electronic sequence controlling system 15, which initiates the lateral advance of each support frame 10 only after the preceding adjacent support frame 10 has advanced a predetermined distance. Such conventional sequence-controlling devices are basically known in connection with self-advancing roof support systems and therefore not shown in detail in the drawing.

The invention permits new ways of relocating a winning face because the self-advancing roof support frames can be readily displaced in the longitudinal direction of the winning face. Such a method for relocating a winning face is explained as follows:

FIG. 1 shows a top view of a winning face in a horizontal seam with trailing working roads. The winning face is supported by the group of self-advancing roof support frames 10 according to the invention. A face conveyor 20 is disposed in front of the self-advancing roof support. Conveyor 20 is not connected with the self-advancing roof support, but is capable of automatically advancing in the longitudinal direction and of travelling through curves while advancing. Such a face conveyor is the object of the older German application No. P 32 41 129.

A conventional winning machine, preferably a cutting winning machine, works ahead of the face conveyor 20. As shown in FIG. 1, in a typical mining problem, one encounters a geological fault within zone "A" of the breast of the working, which stands as an obstacle. This problem is solved by displacing the winning face in its longitudinal direction along the path length "a". Therefore, the winning face evades the fault by turning sideways.

In a preferred embodiment, a barrier or dam "D" supporting the roof is constructed first at the edge of the winning face facing the direction of displacement, using rapidly setting dam construction materials. Subsequently, a short breast winning machine 30 is installed at the face side "b" of the winning face. This winning machine prepares a cut for the installation of a new winning face across the width of the winning face, into which cut or road the support frames 10 advance, automatically migrating sideways while retaining their formation side by side. In the same way, the face conveyor 20 automatically advances in its longitudinal direction into the cut prepared by the short-breast winning machine 30 until the entire face equipment has been displaced sideways by the distance "a" and the winning face can again start the long-breast mining operation. Generally, the support frames 10 and the face conveyor 20 advance simultaneously with the progress in the working of the short-breast winning machine 30, which, for the normal operation, can be swivelled by 90° and used as a stable hole winning machine. For example, the short-breast winning machine 30 may be a conventional cutting machine, partial cutting machine or also a continuous miner.

The space vacated by the laterally advancing support frames 10 at the opposite end of the winning face is supported by a stationary support system 40 such as individual pillars and caps and/or gallery roof anchors. The face conveyor 20 is extended segment by segment in accordance with the movement of the short-breast winning machine.

Figure 2:
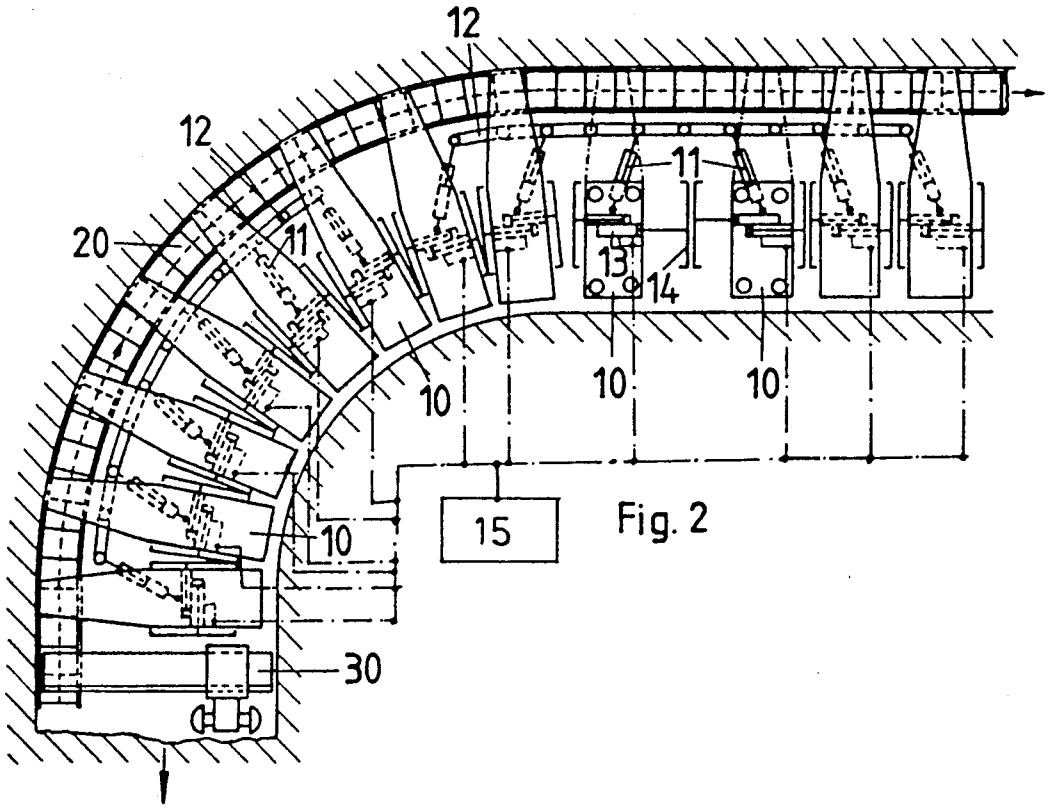
FIG. 2 is a schematic top view showing how the face equipment is guided through a curve.

FIG. 2 shows how the total equipment of the winning face can be relocated, in a new starting position, such as a position which is pivoted or displaced by 90° as compared to the earlier position. In the present case, the support frames 10 and the face conveyor 20 are displaced from a connection road through a curve of 90° and advanced into a cut for the installation of a new winning face that is pivoted by 90°. To permit the elements to pass through the curve, the anchoring beam 12 must be of an articulated design with joints that can be locked for the normal operation. If necessary, the advancing means 11 may be detached from the anchoring beam 12 while the latter is advancing through the curve, in which case the roof, because of the lesser support density necessarily available within the zone of the curve, is additionally secured, with supports such as gallery roof anchors or the like.

Figure 3:
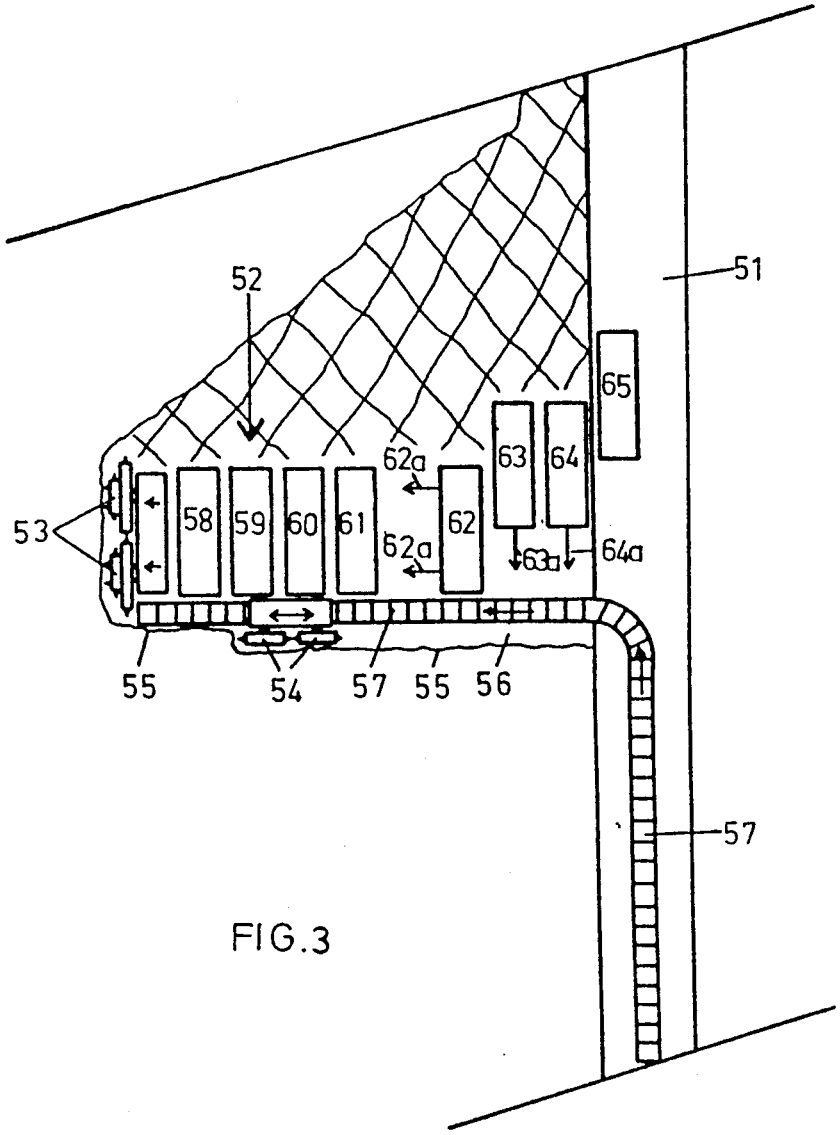
FIG. 3 is a flow diagram for the set-up of a new winning face with a self-advancing roof support according to the invention.

FIG. 3 shows the basic gallery 51 of a newly developed winning face. Disposed sideways adjacent to the basic gallery 51, a cut 52 for installing a new winning face has been prepared in which the new winning face is to be set up. A short-breast winning machine 53 works in the cut 52, extending cut 52 in its longitudinal direction extending perpendicular to the basic gallery. The working direction of the short-breast winning machine 53 is indicated by arrows. In addition, a long-breast winning machine 54 works in the cut, clearing a winning gallery 56 along the breast of the working 55 of the winning face to be set up. The long-breast winning machine 54 is displaceably mounted on a face conveyor 57, which is capable of automatically advancing in its longitudinal direction into the cut. The discharge end of the conveyor 57 is disposed in the basic gallery 51.

In the cut for installing the new winning face, a plurality of self-advancing roof support frames 58, 59, 60, 61, 62, 63 and 64 arranged generally in a row is present to the rear of the face conveyor 57. An additional self-advancing roof support frame 65 is kept ready in the basic gallery 51 for installation in the winning face to be set up.

When the short-breast winning machine 53 at the face side of the cut and the long-breast winning machine at the breast of the working 55 of the winning operation to be set up have each worked coal by the width of one step, the self-advancing roof supports 58-65 may again be advanced by one step sideways and by one step in the direction of the breast of the working 55. In this operation, either the step sideways or the step in the direction of the breast 55 may be performed first, or both steps may be performed simultaneously. However, it is important that each supporting frame 58–65 advance into the new mining field in a diagonal way by combining said two motions of displacement in a way such that the row of self-advancing roof supports always comes to be disposed under freshly exposed roof. Therefore, the hazards of the stamping effect are avoided, which otherwise may destroy the roof. The self-advancing face conveyor 57 advances into the cut 52 as the length of said cut 52 increases. From the basic gallery 51, the self-advancing roof support frames required in the newly developed winning face are installed one after the other. Backfilling material may be admitted into the space to the rear of the row of roof supports and the roof material may be brought down. Once all self-advancing roof supports have been installed in the cut, the short-breast winning machine 53 may be rotated by 90° in the direction of the breast of the working to subsequently serve as a stable hole winning machine.

While only several embodiments and examples of the present invention have been described, it is obvious that many changes and modifications may be made thereunto, without departing from the spirit and scope of the invention.

What is claimed is:

1. A method of relocating a winning face by means of a self-advancing roof support system by installing a new winning face at the head side of the roof support system and which includes a plurality of self-advancing roof support frames having a defined configuration, a plurality of advancing means acting perpendicular to the breast of the working for advancing said plurality of self-advancing roof support frames in the direction of the breast of the working, each of which is associated with one of said roof support frames, a plurality of additional advancing means each of which is associated with one of said roof support frames, acting parallel to the breast of the working, which means cooperate to successively advance the self-advancing roof support frames sideways parallel to the breast of the working, comprising the steps of:

extending a cut for installing the new winning face in the longitudinal direction of the winning face at the head side of the face equipment and widening the cut by the width of a support frame; and advancing the self-advancing roof support into said cut by migrating said supports sideways parallel to the breast of the working while maintaining their configuration.

2. The method as recited in claim 1, wherein the system additionally includes a face conveyor and the method additionally includes the step of advancing the face conveyor in its longitudinal direction into said cut for installing the new winning face.

3. The method as recited in claim 1, wherein extending a cut in the longitudinal direction of the winning face for installing a new winning face is accomplished with a short-breast winning machine, and the method further includes the steps of continuously following said short-breast winning machine with the self-advancing roof support frames and the face conveyor.

4. The method as recited in claim 3, further comprising the step of using the short-breast winning machine, on completion of the cut for the installation of said new winning face, as a stable hole winning machine.

5. The method as recited in claim 1, further comprising the step of guiding the laterally advancing self-advancing roof support frames through curves at the end of an expiring winning face.

6. A method for setting up a new winning face in a winning gallery from a basic gallery in underground mining operations with a self-advancing roof support system which includes a plurality of self-advancing roof support frames in a row, a plurality of advancing means acting perpendicular to the breast of the working for advancing said plurality of self-advancing roof support frames in the direction of the breast of the working, each of which is associated with one of said roof support frames, a plurality of additional advancing means each of which is associated with one of said roof support frames, acting parallel to the breast of the working, which means cooperate to successively advance the self-advancing roof support frames sideways parallel to the breast of the working, comprising the steps of:

extending a cut in the longitudinal direction of the winning face step by step, starting at the basic gallery, by the width of a self-advancing roof support frame and widening the cut by the width of the winning gallery extending in front of the self-advancing roof support;

advancing the self-advancing roof support frames sideways parallel to the breast of the working by one length of the step and by one length of the step in the direction of the breast of the working, after each extension and widening of the cut; and extending the row of self-advancing roof support frames step by step from the basic gallery by newly installed self-advancing roof support frames until all self-advancing roof support frames are installed in the winning face.

7. The method as recited in claim 6, wherein the system additionally includes a face conveyor and the method additionally includes the step of advancing the face conveyor in its longitudinal direction into the cut along the developing breast of the working.

8. The method as recited in claim 6, wherein extending the cut is accomplished with a short-breast winning machine and widening the cut is accomplished with a long-breast winning machine of the face equipment so as to allow for installation of a new winning face.

9. The method as recited in claim 8, further comprising the step of using the short-breast winning machine, after the installation of the face equipment, as a stable hole winning machine.

10. A method of relocating a winning face by means of a self-advancing roof support system by installing a connection road leading with a seam to the new site of the working and which includes a plurality of self-advancing roof support frames having a defined configuration, a plurality of advancing means acting perpendicular to the breast of the working for advancing said plurality of self-advancing roof support frames in the direction of the breast of the working, each of which is associated with one of said roof support frames, a plurality of additional advancing means each of which is associated with one of said roof support frames, acting parallel to the breast of the working, which means cooperate to successively advance the self-advancing roof support frames sideways parallel to the breast of the working, comprising the steps of:

extending a cut in the longitudinal direction of the winning face for installing the connection road leading with a seam to the new site of the working and widening the cut by the width of a support frame; and advancing the self-advancing roof support frames into said connection road by migrating said roof support frames sideways parallel to the breast of the working while maintaining their configuration.

11. The method as recited in claim 10, wherein the system additionally includes a face conveyor and the method additionally includes the step of advancing the face conveyor in its longitudinal direction into the connection road within the seam.

12. The method as recited in claim 10, wherein extending a cut in the longitudinal direction of the winning face for installing a connection road within the seam is accomplished with a short-breast winning machine, and the method further includes the step of continuously following said short-breast winning machine with the self-advancing roof support frames, and the face conveyor.

13. The method as recited in claim 12, further comprising the step of using the short-breasted winning machine, on completion of the cut for the connection road, as a stable hole winning machine.

14. The method as recited in claim 10, further comprising the step of guiding the laterally advancing self-advancing roof supports through curves in the course of a connection road within the seam.

15. The method as recited in claim 10, further comprising the step of guiding the laterally advancing self-advancing roof supports through curves at the inlet leading to the cut.

* * * * *